United States Patent [19]

Shikata et al.

[11] 4,373,480

[45] Feb. 15, 1983

[54] CONSTRUCTION OF POWER TRANSMITTING DEVICE FOR INTERNAL COMBUSTION ENGINE

[75] Inventors: Mitsuo Shikata, Toyonaka; Kazuto Usui, Osaka, both of Japan

[73] Assignee: Yanmar Diesel Engine Co., Ltd., Osaka, Japan

[21] Appl. No.: 128,965

[22] Filed: Mar. 10, 1980

[30] Foreign Application Priority Data

Jan. 17, 1980 [JP] Japan ..... 55-3970

[51] Int. Cl.[3] ..... F02F 7/00

[52] U.S. Cl. ..... 123/195 A; 123/41.11; 474/84; 403/370

[58] Field of Search ..... 123/195 R, 195 A, 90.31, 123/41.31, 41.11, 41.65; 474/84, 86; 403/370, 371–372

[56] References Cited

U.S. PATENT DOCUMENTS

| | | | |
|---|---|---|---|
| 2,150,456 | 3/1939 | Perrine | 123/195 A |
| 2,707,618 | 5/1955 | Brown | 474/86 |
| 2,718,155 | 9/1955 | Firth | 403/370 |
| 2,782,774 | 2/1957 | Jasper | 123/41.65 |
| 2,911,962 | 11/1959 | McRae | 123/195 A |
| 3,596,524 | 8/1971 | Cook | 123/41.11 |
| 4,125,036 | 11/1978 | Nakamura et al. | 123/195 A |

FOREIGN PATENT DOCUMENTS

| | | | |
|---|---|---|---|
| 1455474 | 1/1969 | Fed. Rep. of Germany | 123/41.31 |

*Primary Examiner*—Craig R. Feinberg

*Attorney, Agent, or Firm*—Armstrong, Nikaido, Marmelstein & Kubovcik

[57] ABSTRACT

A power transmission device for internal combustion engine including a timing belt pulley for a timing belt which drives cam shaft and so forth, and a pulley for V belt for driving auxiliary machineries such as cooling fan, the timing belt pulley and the pulley for V belt being attached to an end portion of the engine crank shaft. One of these pulleys is fixed directly to the engine crank shaft, while the other is fixed to the first-mentioned pulley which is fixed to the crank shaft.

2 Claims, 13 Drawing Figures

FIG.3
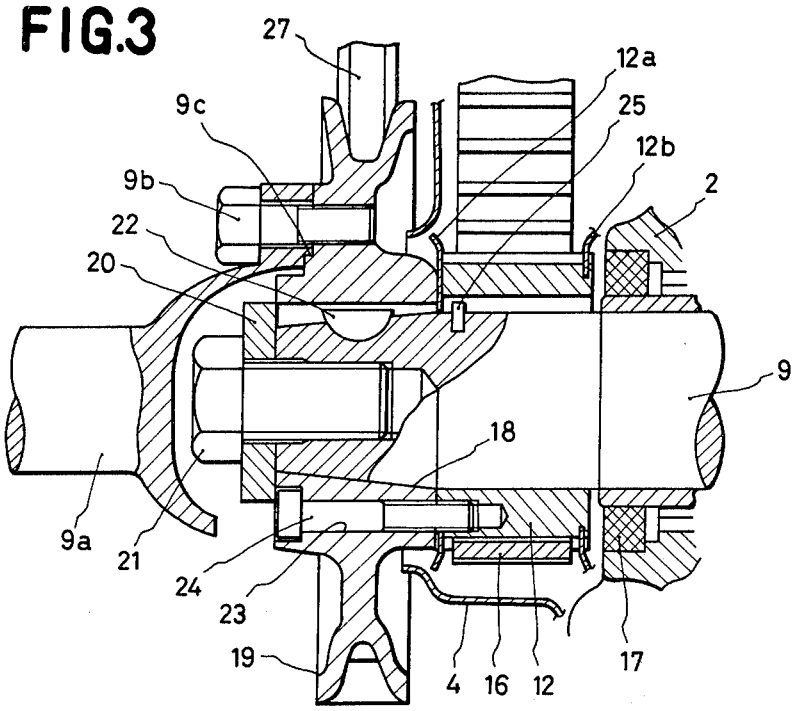
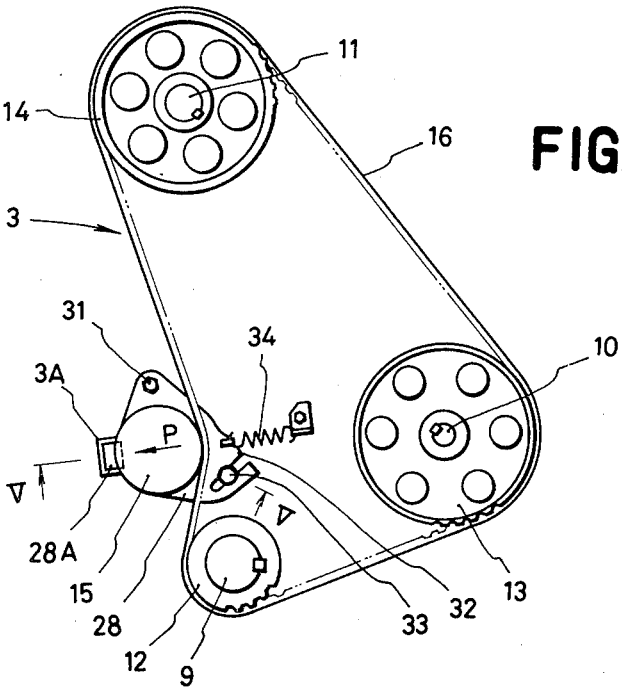
FIG.4

CONSTRUCTION OF POWER TRANSMITTING DEVICE FOR INTERNAL COMBUSTION ENGINE

BACKGROUND OF THE INVENTION

The present invention relates to a construction of power transmitting device for internal combustion engines and, more particularly, to a device for transmitting, through a timing belt, the rotation of the crank shaft of an internal combustion engine to shafts which are adapted to be driven in a timed relation to the engine crank shaft, e.g. a cam shaft, fuel injection pump cam shaft and so forth.

In transmitting the rotation of crank shaft of an internal combustion engine, particularly a diesel engine, to a cam shaft and a fuel injection pump shaft, it is necessary to maintain a predetermined timed relationship between the crank shaft rotation and the rotation of the cam shaft and the like. Therefore, a timing belt is used for the power transmission between these shafts. On the other hand, the power transmission to auxiliary machineries such as cooling fan, water pump, lubricating oil pump and so forth is made through the medium of V belts.

Therefore, the crank shaft of internal combustion engine is provided with a pulley for the timing belt and also a V-pulley for driving auxiliary machineries or for taking out the engine power. To attach these pulleys to the end of the crank shaft, it is necessary to reduce the diameter of the crank shaft at the end portion thereof, and to employ a complicated attaching structure.

Due to the reduced diameter, the mechanical strength of the crank shaft is decreased at the shaft end form which the power is taken out, so that the magnitude of the power taken out through the shaft end is limited undesirably. In addition, if the diameter of the timing belt pulley is reduced for reducing the weight of the engine as a whole, the diameter of the crank shaft end has to be reduced correspondingly to further make it difficult to take out a large power.

The timing belt has a delicate structure as compared with ordinary V belts, and, therefore, is accommodated by a closed timing belt case disposed at one side of the crank case so as to be kept away from the moisture, oil and/or dusts. As the timing belt operates following the rotation of the crank shaft, the timing belt generates heat due to friction to cause a temperature rise in the timing belt case, which in turn heat up the timing belt itself, resulting in a deterioration or breakage of the latter if the belt is kept in this state for a long time.

SUMMARY OF THE INVENTION

It is, therefore, a major object of the invention to improve the construction of the power transmitting device of internal combustion engine.

More specifically, a first object of the invention is to provide a device which permits a fixing of a pulley to a crank shaft without necessitating the reduction of diameter of the crank shaft end to which the pulley is to be attached.

A second object of the invention is to provide means for fixing a pulley for taking out power and a timing belt pulley to an engine crank shaft.

A third object of the invention resides in an improvement in the tension pulley for timing belt, achieved by means for displaceably holding a tension pulley at a predetermined position without suffering undesirable loosening of the fixing bolts for the tension pulley.

A fourth object of the invention is to provide a device for removing heat from a timing belt which is stretched between a plurality of pulleys and adapted to run at a high speed.

A fifth object of the invention is to provide a device capable of automatically discharging water accumulated in a case accommodating a timing belt, thereby to prolong the life of the timing belt.

BRIEF DESCRIPTION OF THE DRAWINGS

FIG. 3 is a side elevational sectional view of a power transmitting end portion of a crank shaft, constructed in accordance with an embodiment of the invention;

FIG. 4 is a front elevational view of a power transmitting device having a tension roller associated with a timing belt, arranged in accordance with an embodiment of the invention;

FIGS. 8 and 9 show a construction of a drain valve for the timing belt case in which: FIGS. 8A and 8B are, respectively, a side elevational sectional view and a bottom plan view, showing a tubular valve member made of an elastic material and having a narrowed end in the closed state; while

DESCRIPTION OF THE PREFERRED EMBODIMENTS

The invention will be more fully understood from the following description of the preferred embodiments taken in conjunction with the accompanying drawings.

Figure 1:
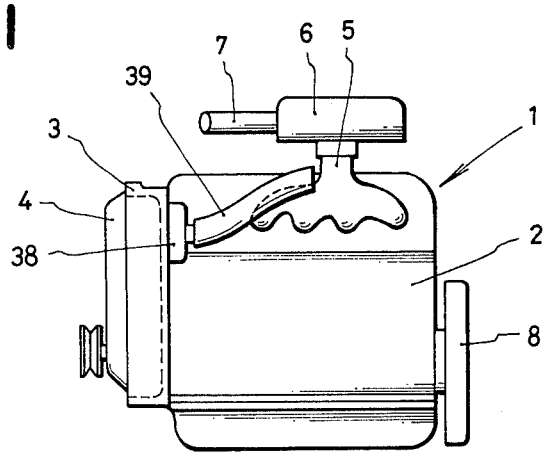
FIG. 1 is a schematic side elevational view of an internal combustion engine.

Referring first to FIG. 1, an internal combustion engine 1 is provided with a timing belt case 3 disposed in front of a main body 2 of the engine. The opening of the timing belt case 3 is closed by means of a cover 4. A pulley for taking out the power is provided in front of the timing belt case 3. An intake manifold 5 communicating with all cylinders is secured to an upper part of the engine main body 2 constituting a cylinder head. An air cleaner 6 and an intake pipe 7 are attached to the intake manifold 5. A reference numeral 8 denotes a fly-wheel to which a mechanism for taking out the engine power is attached as required.

Figure 2:
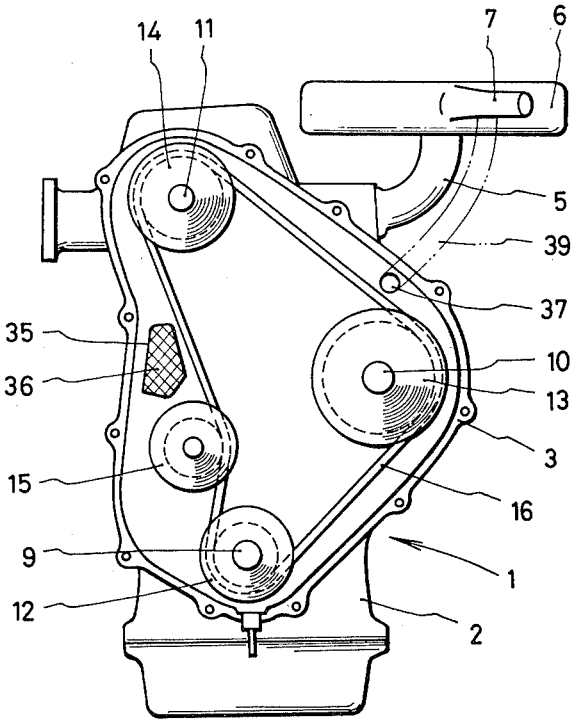
FIG. 2 is a front elevational view of a power transmitting device having a timing belt constructed in accordance with an embodiment of the invention, as viewed with the cover of a timing belt case disposed at the front side of an engine removed.

FIG. 2 is a front elevational view of the engine shown in FIG. 1 with the cover 4 of the timing belt case 3 removed.

A crank shaft 9, fuel injection pump shaft 10 and a cam shaft 11 for driving the intake and exhaust valves are disposed at a lower, intermediate and at an upper portion of the engine body 2. Pulleys 12, 13, and 14 for the timing belt are attached to these shafts. A tension pulley 15 disposed between the pulleys 12 and 14 is adapted to impart a suitable tension to the timing belt. A timing belt 16 is mounted around these pulleys.

Construction of Crank Shaft End

FIG. 3 shows the construction of a crank shaft end through which the engine power is taken out for driving auxiliary machineries and so forth, constructed in accordance with an embodiment of the invention. The crank shaft 9 projects out of the engine body 2. The clearance between the crank shaft end and the crank case wall is sealed by means of an oil seal 17. The crank shaft end is tapered at its outer extremity as at 18 onto which fitted is a V pulley for driving auxiliary machinery of the engine. More specifically, a bolt 21 is screwed into a threaded bore formed in the end surface of the crank shaft 9, through a washer 20 interposed therebetween, thereby to fix the V pulley 19 to the crank shaft 9. The V pulley is prevented from rotating on the crank shaft 9, by a cooperation of a key 22 with a key way formed in the crank shaft. A pulley 12 for the timing belt is also attached to the end of the crank shaft 9 in side-by-side relation to the V pulley 19. The pulley 12 is fixed to the V pulley 19 by means of a bolt 24 which is screwed into a threaded bore in the pulley 12 through a bore 23 formed in the V pulley 19. The reference numeral 25 denotes a pin for locating the pulley 12, and can be substituted by an ordinary key. The key 22 effectively aligns the bore 23 with the threaded bore in the pulley 12, for facilitating the driving of the bolt 24 into the threaded bore through the bore 23.

A transmission shaft **9*a* is fixed to the V pulley 19 by means of bolts 9*b*, so that the rotation of the crank shaft 9 is transmitted to the transmission shaft 9*a*. The transmission shaft 9*a* and the V pulley 19 fit each other at their shoulder portions as at 9*c* so that the transmission shaft 9*a* can be precisely centered with respect to the V pulley 19**.

Reference numerals **12*a*, 12*b* denote guide plates which are adapted to limit the breadthwise movement of the timing belt 16. Preferably, one 12*a* of the guide plates is fixed between the V pulley 19 and the timing pulley 12, while the other 12*b* is fixed to the timing pulley 12** itself.

It is also advantageous to provide the guide plates **12*a*, 12*b* to cooperate with the timing pulley of the smallest diameter, e.g. the timing pulley 12 on the crank shaft 9**, because, by so doing, it is possible to minimize the size (outside diameter) of the guide plates themselves.

The bore formed in the cover 4 and receiving the crank shaft preferably has a diameter smaller than that of the guide plate **12*a***, in order to prevent dusts from coming into the timing belt case during running of the engine.

A V belt 27 for driving the cooling fan, generator and other auxiliary machineries and for taking out the engine power is wound round the V pulley 19.

According to the invention, as will be apparent from FIG. 3, the attaching of the V pulley 19 and the timing belt 12 to the crank shaft 9 is made by fixing the V pulley 19 to the tapered end portion 18 of the crank shaft 9 and then fixing the timing pulley to this V pulley 19. It is, therefore, possible to strongly attach the V-pulley to the crank shaft 9 through the tapered end portion 18 of the latter. In addition, the detaching of the V pulley 19 from the crank shaft 9 can be made much more easily than in the conventional case where the V pulley is fitted to a straight portion of the crank shaft having no taper. In addition, a simple construction for fixing the timing pulley 12 to the V pulley permits an easy and prompt assembling and disassembling and, hence, an easy repair of internal combustion engine.

More specifically, in the conventional arrangement in which the diameter of the crank shaft end is reduced for permitting attaching of V pulley thereto, only 10% or less of the full engine power could be taken out without the danger of rupture, while, according to the construction of the invention, it is possible to take out 60 to 100% of full engine power. In consequence, it becomes possible to drive various auxiliary machineries to widen the use of internal combustion engine.

Belt Tensioning Device

FIG. 4 is a front elevational view showing an essential part of a belt tensioning device constructed in accordance with the invention. This device includes a tension pulley 15 disposed between the pulley 12 mounted on the main shaft, i.e. the crank shaft 9, and a pulley 14 mounted on a driven shaft such as the cam shaft 11, and adapted to press the timing belt 16 from the back side thereof.

Figure 5:
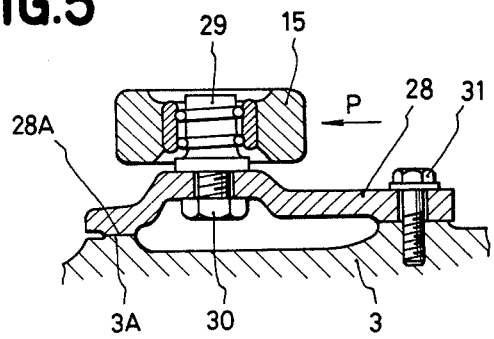
FIG. 5 is a sectional view taken along the line V—V of FIG. 4.

As will be clearly seen from FIGS. 4 and 5, the tension pulley 15 is supported through a bearing by a shaft 29 which is fastened to a tension pulley support 28 by means of a bolt 30.

The tension pulley support 28 is fixed at its one end to the timing belt case 3 by means of a bolt 31, and has an arcuate slot 32 centered at the center of the bolt 31 and receiving a bolt 33 screwed to the timing belt case 3, thereby to permit the timing belt support 38 to be moved toward and away from the timing belt 16.

A spiral spring 34 is adapted to pull the tension pulley support 28 to make the tension pulley 15 press the timing belt 16. In fixing in position the tension pulley 15 mounted on the support 28, it may be operated to move the support 28 to determine a position at which the pulley 28 presses against the timing belt at a certain value of the pressure and fix the support in such position.

In the present invention, a seat 28 is disposed at the opposite side of the tension pulley 15 to the spring 34. Also, a seat 3A opposing to the seat 28A is formed on the timing belt case 3.

As will be clearly seen from FIG. 4, the bolt 33 is positioned at one side (right side) of the line interconnecting the bolt 31 and the tension pulley 15, while the seats 28A and 3A are positioned at the other side (left side) of the line. Therefore, the bolt 31, bolt 32 and the seat 28A are positioned to occupy apices of a triangle, thereby to stably hold the tension pulley support 28.

In the conventional tension pulley device, no seat is provided for supporting the tension pulley support 28 on the timing belt case 3. Therefore, the tension pulley support 28 could not be held stably to cause a bending or loosening of the bolts 31, 33, as well as jolting of the tension pulley support 28. According to the invention, however, the bending and loosening of the bolts 31, 33 do not take place even when the tension pulley support 28 is swung or vibrated by the tension applied to the tension belt 16 or the vibration applied by the same, because the tension pulley support 28 is stably held at three points.

In the embodiment shown in FIG. 5, seats 28A and 3A are formed on the tension pulley support 28 and the timing belt case 3, respectively, so as to make a sliding contact with each other. This arrangement, however, is not essential and the seat 3A may be neglected to permit a direct contact of the seat 28A with the surface of the timing belt case 3.

Timing Belt Cooling Device

Since the timing belt has a poor resistance to water or oil, it is a current tendency to accommodate the timing belt in a fully closed timing belt case having a cover for completely sealing the space inside the case from the ambient air. This, however, causes a considerable rise of the temperature of atmosphere in the timing belt case, resulting in a rapid wear of the timing belt. In fact, in case of high-speed and high-power engines, it is necessary to renew the timing belt in only 2000 to 3000 hours. According to the invention, this problem is overcome by a timing belt cooling device as will be understood from the following description.

As shown in FIG. 1, a timing belt case 3 disposed in front of the internal combustion engine 1 accommodates the timing belt pulleys 12, 13, 14 as well as the tension pulley 15. The opening of this timing belt case 3 is completely closed by the cover 4. The invention aims also at preventing the temperature rise of the timing belt accommodated by this completely closed timing belt case.

To this end, according to the invention, an air sucking port is formed in the timing belt case or in the cover thereof, so that a part or whole of the intake air to be supplied to the engine is induced through this air sucking port.

Figure 6:
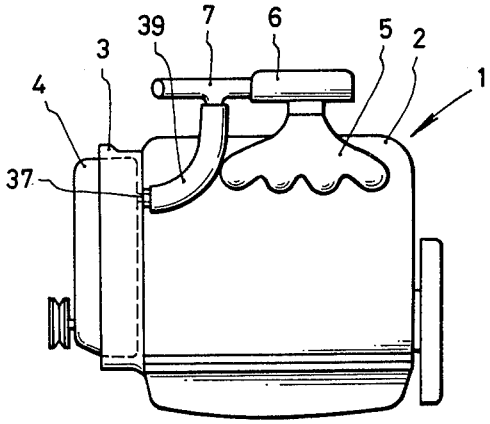
FIG. 6 is a side elevational view of an internal combustion engine having means for cooling the interior of the timing belt case.
Figure 7:
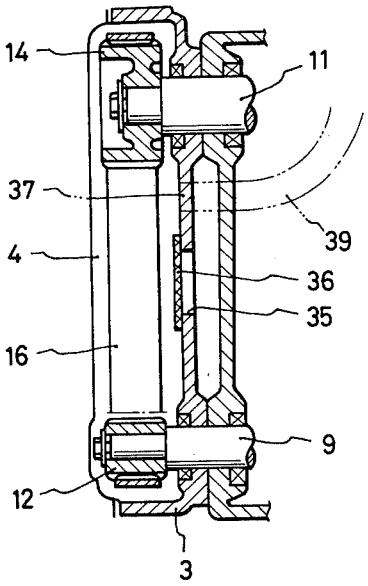
FIG. 7 is a side elevational sectional view of the timing belt case.

As shown in FIGS. 2, 6 and 7, pulleys 12, 13, 14 and 15 are accommodated by the timing belt case 3, and the timing belt 16 is wound round these pulleys. As will be seen from FIG. 2, an air sucking port 35 formed in the timing belt case 3 is covered by a filter 36. An air discharge port 37 is formed at a position sufficiently spaced from the air sucking port 35. As shown in FIGS. 6 and 2, the air discharge port 37 is connected through an intake air communication pipe 39 to an upstream portion of an intake pipe 7 which in turn is connected to the air cleaner 6.

The intake air communication pipe 39 may be connected to the downstream side of the air cleaner 6, e.g. directly to the intake manifold 5, if an auxiliary air cleaner 38 is disposed in the timing belt case 3.

During running of the internal combustion engine, a part of the intake air flows into the engine through the air sucking port 35, interior of the timing belt case 3, air discharge port 37, and, then, through the intake air communication pipe 38. As a result, the interior of the timing belt case is forcibly cooled by the flow of the intake air.

Since at least a part of the intake air is forcibly made to flow through the interior of the timing belt case 3, it is possible to maintain the temperature of the timing belt 16 sufficiently low, thereby to increase the durability of the timing belt 16. In addition, since the supply of air to the timing belt case is made by an efficient use of the flow of intake air, it is possible to effectively cool the timing belt 16 without using any specific apparatus.

In the described embodiment, the air sucking port and the air discharge port are formed in the timing belt case. This however, is not exclusive, and an equivalent effect is achieved by forming one or both of these ports in the timing belt case cover.

Draining Device for Timing Belt Case

The timing belt is accommodated by the closed timing belt case so as to be kept away from water, oil and other contaminant. It is often experienced that water is accumulated at the bottom of the timing belt case, particularly when the case is of fully closed type, due to a condensation of moisture in the air or leak of water through the seal. It has been proposed, in order to discharge the water and oil from the timing belt case, to form a drain port at the bottom of the timing belt case.

This drain port, however, cannot check mud and water coming into the timing belt case and attaching to the timing belt.

Under this circumstance, the present invention proposes to provide an automatic drain valve at the bottom of the timing belt case, the valve being adapted to open only during draining, i.e. discharging of water and oil from the timing belt case.

Figure 9A:
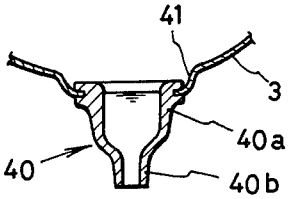
FIGS. 9A and 9B are, respectively, a side elevational view and a bottom plan view, showing the above-mentioned valve member in the operated state.
Figure 9B:
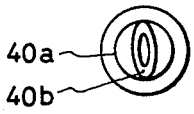
Figure 10A:
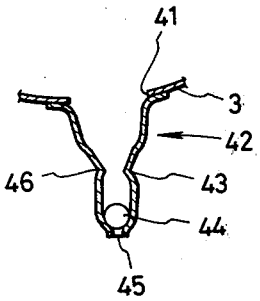
FIGS. 10A and 10B are sectional side elevational views showing a float valve in the closing state and in the state of draining, respectively.
Figure 10B:
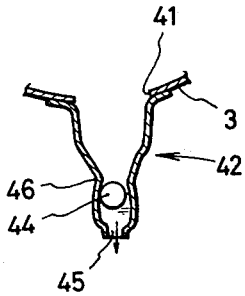

FIGS. 8 to 10 in combination show embodiments of the invention having this automatic drain valve.

Figure 8A:
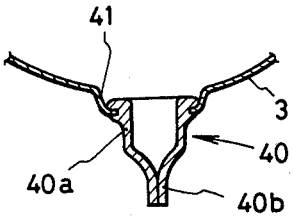
Figure 8B:
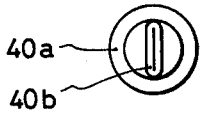

More specifically, FIGS. 8A, 8B and FIGS. 9A, 9B illustrate an embodiment having a tubular valve member 40 made of an elastic member such as rubber and provided with a narrowed end, the tubular valve member fitting an opening 41 formed at the bottom of the timing belt case 3. The tubular valve member 40 has a water pool section 40*a* and a narrowed end portion 40*b*. The narrowed end portion 40*b* is normally kept closed by the elasticity of the rubber, as shown in FIGS. 8A and 8B, but is opened when a certain amount of water is accumulated in the water pool section 40*b*, due to the weight of the water to discharge the water from the water pool section 40*a* automatically, as shown in FIGS. 9A and 9B.

FIG. 10 shows another embodiment in which a float valve 42 is disposed outside the opening 41. The float valve 42 is constituted by a casing 43 having a small aperture formed at the lower end thereof, and a float 44. Also, a restriction 46 for limiting the upward movement of the float 44 is formed at an intermediate portion of the casing 43. It will need no explanation for understanding that the float valve 42 operates in accordance with the amount of water accumulated in the casing 43.

As has been described, according to the invention, an opening 41 is formed at the bottom of the fully-closed type timing belt case 41, and an automatic drain valve is fitted to the opening to open automatically to discharge the water and oil when a predetermined amount of water or drain has been accumulated in the timing belt case. In consequence, the undesirable immersion of the timing belt in water or oil accumulated in the timing belt case and, hence, the adverse affect by such water and oil, are fairly avoided. In addition, since the automatic drain valve is normally closed to seal the interior of the timing belt case completely, mud and water are prevented from coming into the timing belt case, and the timing belt is completely protected against water, oil, mud and so forth.

Since the discharge of water and oil is made fully automatically, any accident caused by mis-handling of the drain valve is completely avoided. Thus, the present invention provides a draining device for timing belt case which is highly effective and which is easy to handle.

What is claimed is:

1. A power transmitting device for an internal combustion engine, said device comprising:

(a) a crankshaft having a tapered end portion;

(b) a timing belt pulley mounted on said crankshaft adjacent to said tapered end portion;

(c) a transmission shaft having first shoulder means spaced radially outward at one end thereof, wherein said power take out pulley includes second should means and wherein said transmission shaft is fixedly connected to said take out pulley with said first shoulder means engaging said second shoulder means; and (d) a power take-out pulley mounted by fixing it in position on said crankshaft on the tapered end portion thereof; wherein the timing belt pulley is fixed to the power take-out pulley by fixing the power take-out pulley to the tapered end portion of the crankshaft and then fixing the timing pulley to the power take-out pulley.

2. A power transmitting device as set forth in claim 1 including a timing belt operably coupled to said timing belt pulley and a timing belt casing attached to the engine for covering said timing belt and said timing belt pulley.

* * * * *